United States Patent [19]

Burns

[11] 4,414,700

[45] Nov. 15, 1983

[54] DEVICE FOR PREPARING A SURFACE FOR PAINTING

[75] Inventor: Fredrick B. Burns, S. Milwaukee, Wis.

[73] Assignee: EZ Paintr Corporation, Milwaukee, Wis.

[21] Appl. No.: 295,659

[22] Filed: Aug. 24, 1981

[51] Int. Cl.[3] ..... A47L 13/12

[52] U.S. Cl. ..... 15/105; 15/111; 15/118; 15/209 D; 15/244 B

[58] Field of Search ..... 15/105, 111, 118, 244 R, 15/244 B, 244 C, 244 A, 245, 209 D, 209 C

[56] References Cited

U.S. PATENT DOCUMENTS

| | | | |
|---|---|---|---|
| 2,066,420 | 1/1937 | Reysa | 15/105 |
| 2,109,626 | 3/1938 | Sowers | 15/245 X |
| 2,113,452 | 4/1938 | Long | 15/105 |
| 2,123,947 | 7/1938 | Hertzberg | 15/105 |
| 2,941,225 | 6/1960 | Paul | 15/209 D X |
| 2,958,593 | 11/1960 | Hoover et al. | 15/209 C X |
| 3,112,584 | 12/1963 | Cameron | 15/209 C X |
| 3,199,139 | 8/1965 | Vallis | 15/244 R X |
| 3,638,270 | 2/1972 | Schlegel et al. | 15/244 B X |

*Primary Examiner*—Chris K. Moore

*Attorney, Agent, or Firm*—McDermott, Will & Emery

[57] ABSTRACT

A device for preparing a surface for painting by removing old, pealing paint, dirt and similar material includes a mounting base to which a handle is attached. A pad is removably secured to the base to provide an abrasive/-cleaning surface and, in one embodiment, includes an inner portion of absorbent material surrounded by a second portion of abrasive material. The absorbent portion will hold a supply of cleaning fluid, such as water or paint thinner to facilitate the cleansing process. In an alternative embodiment, the pad includes an inner abrasive material portion surrounded by an absorbent material.

5 Claims, 4 Drawing Figures

FIG. 1
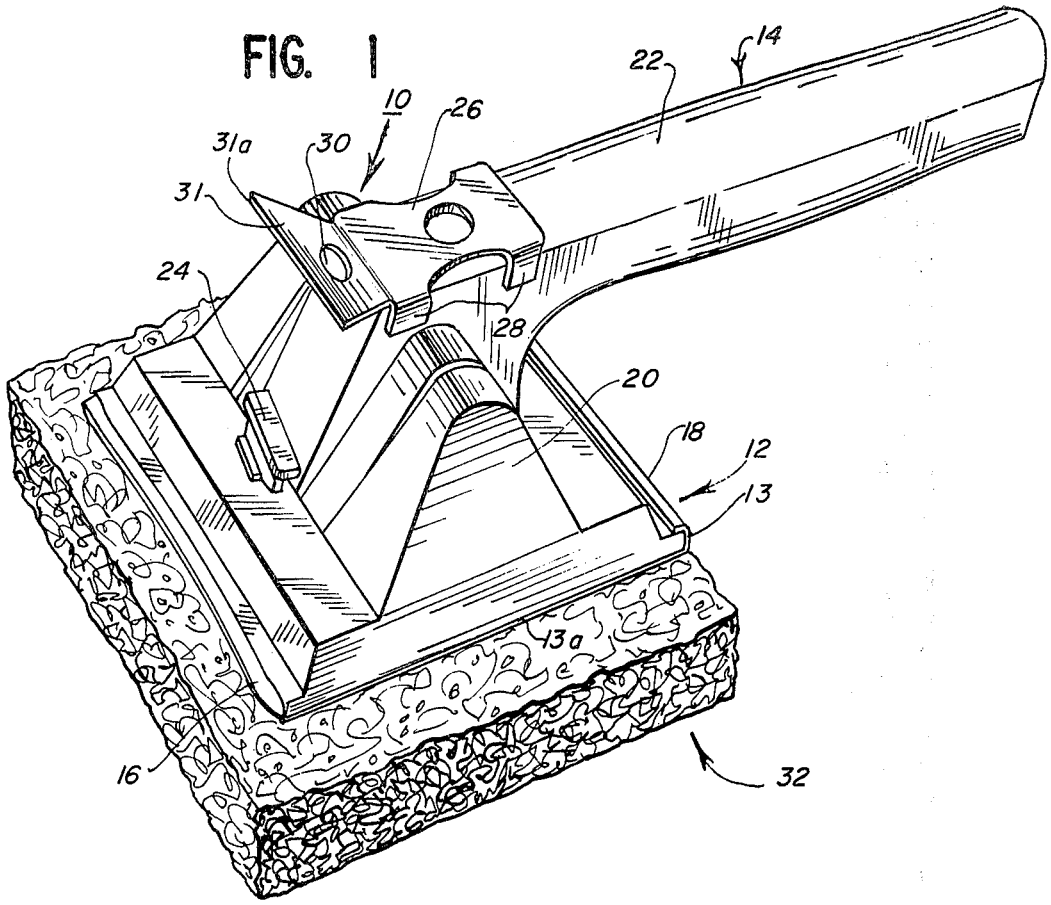
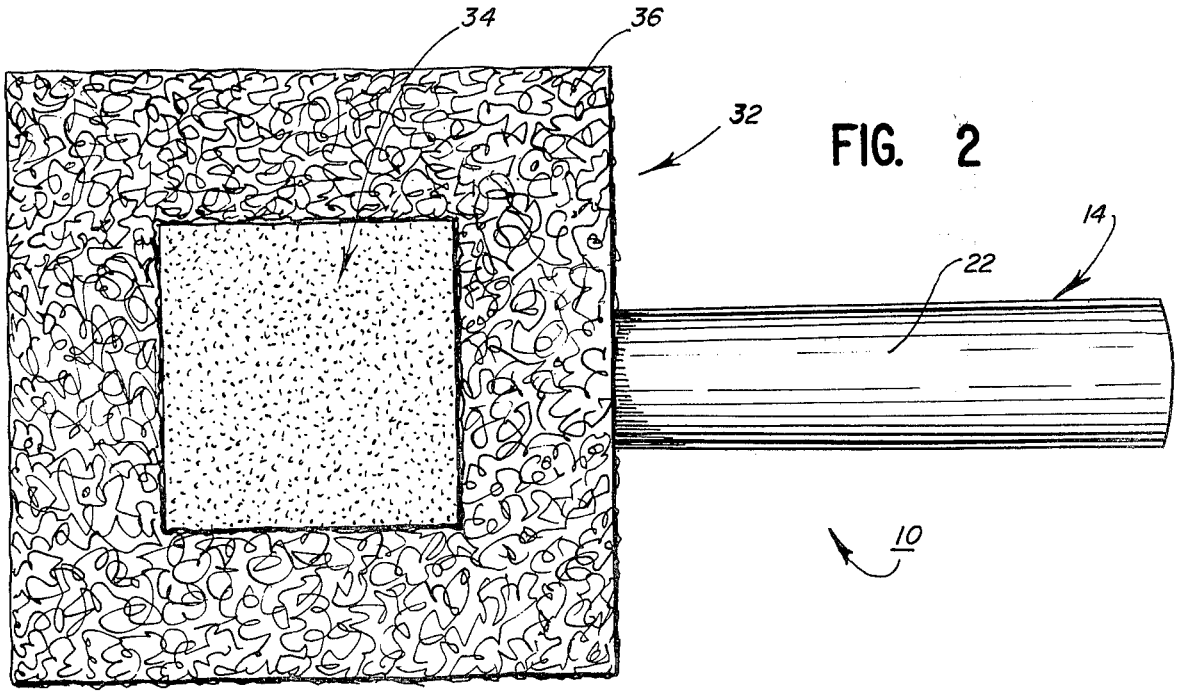
FIG. 2

FIG. 3
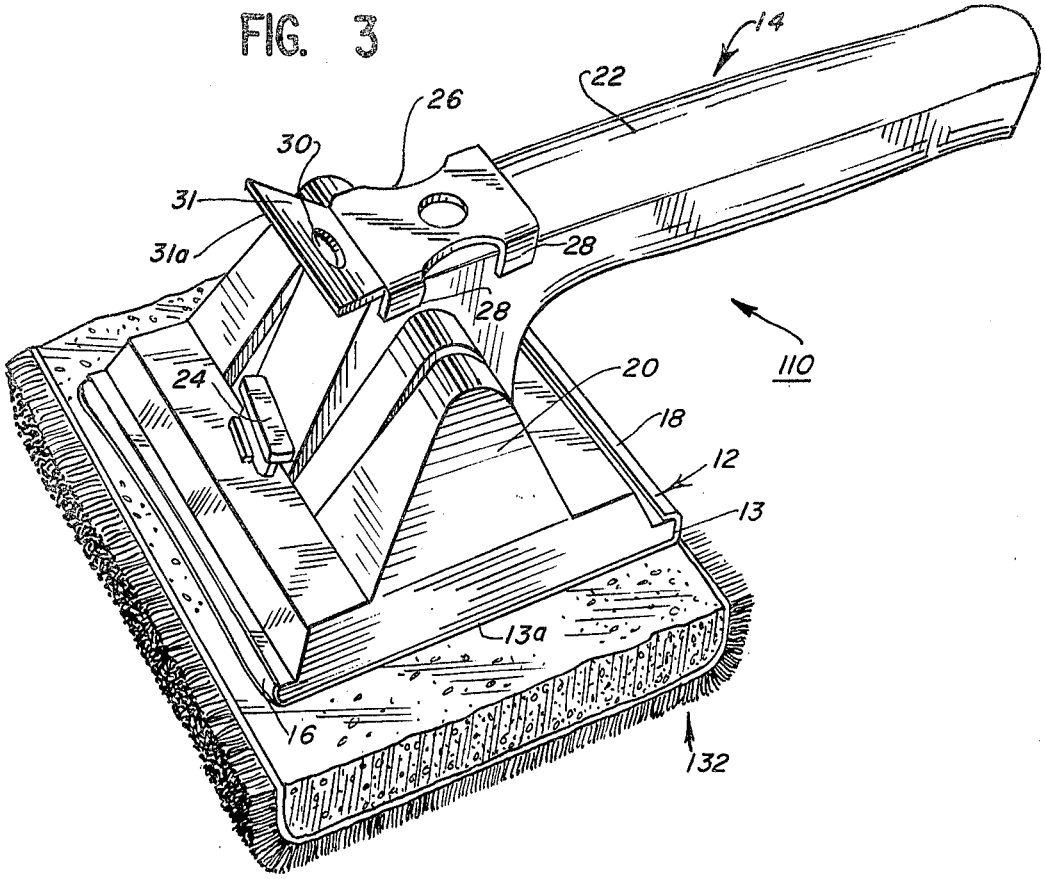
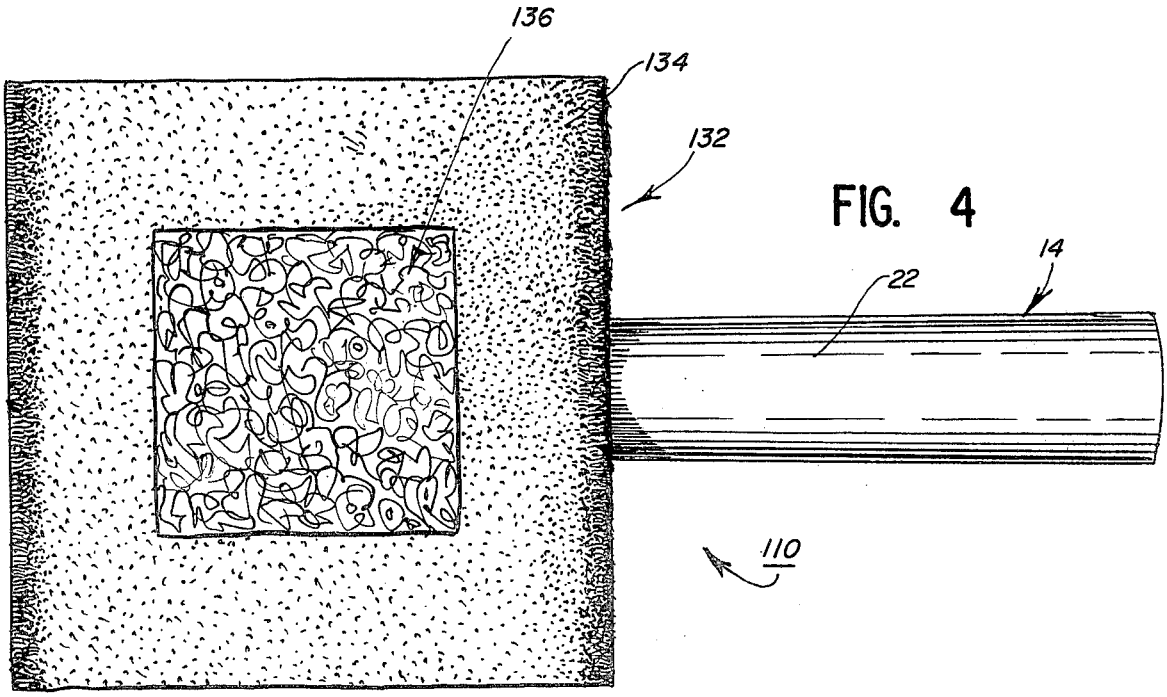
FIG. 4

DEVICE FOR PREPARING A SURFACE FOR PAINTING

BACKGROUND OF THE INVENTION

1. Field of the Invention

The present invention relates to a new and improved device for removing paint, dirt, and similar materials from a surface prior to painting.

2. Description of the Prior Art

Prior to refinishing an object, such as a piece of furniture, or repainting a surface, such as the side of a house, the old varnish, paint, accumulated dirt and similar material should be removed from the surface in order to assure proper adhesion of new material applied to the surface. In the prior art this is accomplished through the use of devices such as sand paper, wire brushes, scrapers, putty knives and similar devices. These particular prior art devices all work on a dry surface and create substantial dust and debris. In addition, these prior art devices require the use of a hand and necessitate a ladder if being used to remove paint or similar material from a surface far off the ground.

It would be advantageous to provide a device for removing paint, dirt, scum, and similar material that is more efficient than the prior art devices, that works on a dry surface and is able to reach high, out of the way places, without the necessity of a ladder. Devices have been prepared to clean surfaces such as that disclosed in U.S. Pat. Nos. 3,199,139, 2,804,728, 3,611,468, 3,629,896, 3,638,270, and 3,857,133.

SUMMARY OF THE INVENTION

An object of the present invention is to provide a new and improved device for removing material such as paint, dirt and the like from a surface prior to painting or otherwise covering.

Another object of the present invention is to provide a new and improved device including a portion of first abrasive material for removing paint or the like from a surface and a second material that absorbs and dispenses a liquid onto the surface from which the material is to be removed.

Yet another object is to provide a device of the character described which can be removably secured to a base or handle portion to facilitate grasping by the user while providing economy in use.

The present invention is directed to a new and improved device for removing material such as paint and the like from a surface. The device includes a base to which a handle is attached. Also attached to the base is a pad of two materials, the first material of which is a liquid absorbent material that absorbs and dispenses liquid onto the surface from which the material, such as paint and the like, is to be removed. The pad also includes a second abrasive material that when moved across the surface removes paint and similar material from that surface.

DESCRIPTION OF THE DRAWINGS

The above and other objects and advantages and novel features of the present invention will become apparent from the following detailed description of preferred embodiments of the invention illustrated in the accompanying drawings, wherein:

FIG. 1 is a perspective view of a first embodiment of a device constructed in accordance with the principles of the present invention;

FIG. 2 is a bottom view of the first embodiment of the device of the present invention;

FIG. 3 is a perspective view of a second embodiment of the device of the present invention; and FIG. 4 is a bottom view of the device illustrated in FIG. 3.

DESCRIPTION OF THE PREFERRED EMBODIMENTS

Referring initially to FIGS. 1 and 2, there is illustrated a device generally designated by the reference numeral 10 constructed in accordance with the principles of the present invention. The device 10 is intended to remove material, such as paint, dirt, or the like, from a surface and may be employed to remove, for example, varnish from a piece of furniture that is to be refinished, or it may be used to remove paint from a wall of a house. The device 10 may be hand held, or attached to an extension pole and used to remove paint or similar material from a location substantially above ground without the necessity of using a ladder.

The device 10 includes a base member 12 to which is attached a handle 14. The base 12 and the handle 14 and the means of connecting the handle 14 to the base 12 are described in U.S. Pat. Nos. 3,369,268 and 3,473,183. Accordingly, the structure of the base 12 and handle 14 will only briefly be described. The handle 14 includes internal threads (not shown) into which an extension pole may be threaded to allow the use of the device 10 at locations substantially above ground without the necessity of a ladder. The base or backing member 12 has attached thereto a rigid metal plate 13 formed by stamping or the like and in the preferred embodiment illustrated is generally rectangular shaped. The plate 13 includes planar upper surface 13*a* and a first or front flange 16 that extends upwardly from the planar surface 13*a* and at the rear edge of the plate 13 a second flange 18 also extends upward from the surface 13*a*. The flanges 16 and 18 extend from end to end of the plate 13.

The handle 14 is formed of two parts, a connecting portion 20 and gripping member 22. The connecting portion 20 defines a male member that cooperates with the female member formed by the flanges 16 and 18 to releasably mount the plate 13 to the base 12 and handle 14. The gripping portion 22 may be pivoted relative to the portion 20 in a manner described in the U.S. Pat. Nos. 3,369,268 and 3,473,183 and is controlled by a lock 24 that in a first position allows the handle 22 to pivot relative to the portion 20 and in a second position locks the handle 22 rigidly relative to the portion 20 allowing for different modes of operation. The device 10 also includes a rigid or metallic scraper 22 that is secured by integral clamps 28 embedded in the gripping portion 22 of the handle 14. The scraper 26 includes an extended flange 31 with a sharp, flat edge which can be used for scraping during the cleaning process described hereinafter. The flange 31 is of a configuration that other instruments such as a larger scraper or a wire brush may be attached to the scraper 26 and used to remove paint, dirt or similar material.

Secured to the plate 13 is a pad generally designated by the reference numeral 32. The pad 32, in the embodiment illustrated, includes a first piece of material 34 (FIG. 2) that is rectangular or square in configuration and is of an absorbent material such as a foam sponge or similar material capable of absorbing a cleaning fluid, such as water, mildew wash, detergent, mineral spirits and the like. The absorbent material will gradually distribute the liquid upon compression of the material 34 or due to gravity. Thus, as the device 10 is moved over a surface, liquid is dispensed from the material 34 onto a surface. The material 34 preferably includes on the outer surface thereof, fibers or bristles that assist in the dispension of liquid onto the surface.

Surrounding the first material 34 is a second material 36 that is also of a square or rectangular configuration and may be a nylon fiber, open textured, non-woven web including abrasive cleaning particles dispensed throughout and bonded to the material with a durable adhesive. Such a material is distributed by 3M Corporation and is designated as the Scotch-Brite Thick Line Floor Pad. The material 36 and its highly abrasive qualities removes material, such as paint, dirt, and the like, from a surface.

To use the device 10, the entire pad 32 is dipped in a container of liquid, such as water, to allow it to absorb water. Thereafter, the device 10 may be applied to the surface from which paint or the like is to be removed, and a scraping action or scrubbing action over the surface by the device 10 is conducted. As this operation occurs, liquid is dispensed from the material 34 onto the surface lubricating and cooling the surface and allowing removal of the material, such as dirt, paint and the like, from the surface. It has been found that the use of liquid in this scraping process is five times as efficient as a dry process wherein no liquid is employed. The liquid dispensed by the material 34 also reduces clogging and cuts down dust generation created by the removal of the material from the surface. In addition, to provide the optimum wet abrasion properties, the pad 32, in the embodiment illustrated in FIGS. 1 and 2, includes a high ratio of abrasive material area to liquid dispensing material area thereby providing an aggressive abrasion device 10.

If it is desired to have a high ratio of liquid dispensing area to abrasive area to provide efficient flushing and scrubbing action of the surface, the embodiment of the device of the present invention illustrated in FIGS. 3 and 4 is preferred. The device in FIGS. 3 and 4 is generally designated by the reference numeral 110; however, the device 110 includes a handle 14 and base member 12 substantially the same as that described in the embodiment illustrated in FIGS. 1 and 2. Accordingly, those similar structures in the embodiment of FIGS. 3 and 4 are given the same reference numerals as appears in FIGS. 1 and 2 and will not be described herein. The structure that is different in FIGS. 3 and 4 from that of the embodiment of FIGS. 1 and 2 is the pad generally designated by the reference numeral 132 in FIGS. 3 and 4. The pad 132 provides a high ratio of liquid dispensing area to abrasive area, thereby providing an efficient device for flushing and scrubbing action on a surface. The pad 132 includes a first centrally located material 136 that is of the same material as the material 36 in the embodiment illustrated in FIGS. 1 and 2. The material 136 is highly abrasive and intended to remove material such as paint and the like from a surface. The material 136 is surrounded by a second material 134 that corresponds to the material 34 described with respect to the embodiment illustrated in FIGS. 1 and 2. As can be understood, the pad 132 illustrated in FIGS. 3 and 4 is the opposite of the pad 32 illustrated in FIGS. 1 and 2 in that the liquid dispensing material 134 is of a greater area than the abrasive material 136. Since the pads 32 and 132 may be attached to the same structures, specifically the base member 20, the pads 32 and 132 are interchangeable on the same device, depending on what is sought to be accomplished by the device.

What is claimed and sought to be secured by Letters Patent of the United States is:

1. A device for preparing a surface for coating and removing paint or similar material, comprising:

a base having attachment means, a handle secured to said base, a pad removably connected to said base of said attachment means, said pad including a first abrasive material for removing said paint or similar material and a second liquid absorbing material for dispensing liquid onto said surface from which said paint or similar material is to be removed, and a rigid scraper secured to said handle including means for attaching a material removing device thereto.

2. The device set forth in claim 1 wherein said first abrasive material at least partially surrounds said second liquid absorbing material and is of a greater area than the area of said second liquid absorbing material.

3. The device set forth in claim 1 wherein said second liquid absorbing material at least partially surrounds said first abrasive material and said second liquid absorbing material is of a greater area than the area of said first abrasive material.

4. The device set forth in claim 1 wherein said first abrasive material comprises a nylon fiber, open textured, non-woven web with abrasive cleaning particles dispersed throughout that are bonded to said web.

5. The device set forth in claim 1 wherein said second liquid absorbing material comprises a liquid retaining material that absorbs and contains liquid and dispenses said liquid upon compression, and fibers secured to said liquid retaining material for uniformly dispensing said liquid.

* * * * *